US007686009B2

(12) United States Patent
Park et al.

(10) Patent No.: US 7,686,009 B2
(45) Date of Patent: Mar. 30, 2010

(54) OVEN WITH COOLING DOOR

(75) Inventors: Sung Soo Park, Hwaseong-Si (KR); Pung Yeun Cho, Suwon-Si (KR); Cheol Jin Kim, Suwon-Si (KR); Kyoung Ho Kim, Suwon-Si (KR); Kil Young Lee, Suwon-Si (KR); Sung Kwang Kim, Ansan-Si (KR); Yu Jeub Ha, Suwon-Si (KR); Yun Ic Hwang, Suwon-Si (KR); Sang Hyun Kang, Seoul (KR); Seok Weon Hong, Yongin-Si (KR); Tae Ho Kim, Hwaseong-Si (KR)

(73) Assignee: Samsung Electronics Co., Ltd, Suwon-Si (KR)

( * ) Notice: Subject to any disclaimer, the term of this patent is extended or adjusted under 35 U.S.C. 154(b) by 505 days.

(21) Appl. No.: 11/297,424

(22) Filed: Dec. 9, 2005

(65) Prior Publication Data

US 2006/0278214 A1 Dec. 14, 2006

(30) Foreign Application Priority Data

Jun. 10, 2005 (KR) ..... 10-2005-0049756

(51) Int. Cl.
*F23M 7/00* (2006.01)

(52) U.S. Cl. ..... 126/190; 126/198; 126/200; 126/273; 126/21 A; 219/391; 219/392; 219/396; 219/739

(58) Field of Classification Search ..... 126/190, 126/198, 200, 273, 273 R, 21 A, 21 R, 80, 126/77; 110/173, 175 A, 175 R; 432/739; 219/393, 400, 739, 391, 392, 396; 431/43
See application file for complete search history.

(56) References Cited

U.S. PATENT DOCUMENTS 3,659,579 A * 5/1972 Henderson et al. ..... 126/21 A (Continued)

FOREIGN PATENT DOCUMENTS

FR 2655132 * 11/1989

(Continued)

OTHER PUBLICATIONS

Official Action issued by the Russian Patent Office in Application No. 2005137248/03(041583) (4 pages) (3 pages of English translation).

*Primary Examiner*—Steven B McAllister
*Assistant Examiner*—Avinash Savani

(57) ABSTRACT

Disclosed herein is an oven that is capable of discharging hot air generated when cooling a door and heat generated in a cooking chamber through the lower end of the door. The oven includes a door having at least two separated air channels. The air channels comprise at least one first air channel to discharge hot air generated when cooling the door through the lower end of the door, and at least one second air channel to introduce air through the lower end of the door such that the door is cooled. In the housing is mounted a circulating fan. Between the circulating fan and the air channels is connected a channel connecting unit. As the circulating fan is rotated, air flows along the second air channel to cool the door. Hot air generated when cooling the door is introduced into the first air channel through the channel connecting unit, and is then discharged out of the oven through the lower end of the door.

12 Claims, 4 Drawing Sheets

U.S. PATENT DOCUMENTS 3,889,100 A * 6/1975 Dills ..... 219/393
5,387,258 A * 2/1995 Puricelli ..... 126/21 A
5,441,036 A * 8/1995 Mikalauskas et al. ..... 126/198
6,904,904 B2 * 6/2005 Walther et al. ..... 126/198
7,060,940 B2 * 6/2006 Kim et al. ..... 219/400
2006/0278214 A1 * 12/2006 Park et al. ..... 126/273 R

FOREIGN PATENT DOCUMENTS

FR 2655132 A * 5/1991
KR 2005-35776 4/2005

* cited by examiner

OVEN WITH COOLING DOOR

CROSS-REFERENCE TO RELATED APPLICATIONS

This application claims the benefit of Korean Patent Application No. 2005-49756, filed on Jun. 10, 2005 in the Korean Intellectual Property Office, the disclosure of which is incorporated herein by reference.

BACKGROUND OF THE INVENTION

1. Field of the Invention

The present invention relates to an oven and, more particularly, to an oven that is capable of discharging hot air generated when cooling a door and heat generated in a cooking chamber through the lower end of the door.

2. Description of the Related Art

Generally, an oven is a kitchen appliance that heats food, which is placed in an enclosed cooking space, to cook the food. Based on heat sources, ovens are classified into an electric oven, a gas oven, and a microwave oven. The electric oven uses an electric heater as the heat source, the gas oven uses gas heat as the heat source, and the microwave oven uses frictional heat of water molecules due to microwaves as the heat source.

When food is cooked by such an oven, the interior temperature of a cooking chamber is increased up to approximately 300° C. As a result, heat generated in the cooking chamber is transmitted to a door, and therefore, the door is heated. For this reason, the oven has a door cooling apparatus to prevent a user from being burned by the heated door. Examples of an oven having such a door cooling apparatus are disclosed in Korean Registered Utility Model Publication No. 132999 and Korean Unexamined Patent Publication No. 2005-35776.

In the conventional oven, however, hot air generated when cooling the door is discharged in front of the oven through the upper end of the door. As a result, the hot air is directed to the face of a user, when the user observes the state of food being cooked, and therefore, the user feels unpleasantness.

Furthermore, if heat generated in the cooking chamber is discharged together with the hot air generated when cooling the door, the temperature of the discharged air is increased, and vaporized oil is also discharged in front of the oven. Consequently, the user's unpleasantness is increased.

SUMMARY OF THE INVENTION

Therefore, it is an aspect of the invention to provide an oven that is capable of discharging hot air generated when cooling a door and heat generated in a cooking chamber through the lower end of the door.

In accordance with one aspect, the present invention provides an oven including: a cooking chamber disposed in a housing; a door to open and close the cooking chamber, the door having at least two air channels, which are separated from each other; a circulating fan in the housing outside the cooking chamber; and a channel connecting unit to connect suction and discharge parts of the circulating fan and the at least two air channels, wherein at least one of the air channels includes a first air channel, having one end connected to the discharge part of the circulating fan via the channel connecting unit and the other end connected to the outer space communicating with the lower end of the door, to guide air discharged by the circulating fan to the lower end of the door such that the air is discharged out of the oven through the lower end of the door. Consequently, the air blown by the circulating fan is discharged out of the oven through the lower end of the door via the channel connecting unit and the first air channel, and therefore, a user does not feel the unpleasantness of the discharged hot air.

Preferably, at least one of the air channels includes a second air channel, having one end connected to the suction part of the circulating fan via the channel connecting unit and the other end connected to the outer space communicating with the lower end of the door, to guide air suctioned by the circulating fan from the lower end to the upper end of the door such that the door is cooled by the air.

Preferably, the door includes an outside glass, an intermediate glass, and an inside glass, which are sequentially disposed between the front surface and the rear surface of the door while being spaced a predetermined distance from one another. The first air channel is formed between the inner side glass and the intermediate glass, and the second air channel is formed between the intermediate glass and the outside glass.

Preferably, the channel connecting unit includes: a first channel connecting unit to connect the discharge part of the circulating fan and one end of the first air channel; and a second channel connecting unit to connect the suction part of the circulating fan and one end of the second air channel.

Preferably, the first channel connecting unit includes: at least one outlet port formed at the front surface of the housing such that the air discharged by the circulating fan flows out of the housing through the outlet port, and is then introduced into the first air channel; and an outlet duct disposed between the outlet port and the discharge part of the circulating fan. Also preferably, the first channel connecting unit further includes a guide member disposed between the outlet port and the first air channel to guide the air discharged through the outlet port to the first air channel.

Preferably, the second channel connecting unit includes: at least one inlet port formed at the front surface of the housing such that air passing along the second air channel is introduced into the housing through the inlet port; and an inlet duct disposed between the inlet port and the suction part of the circulating fan.

Preferably, the door further includes an upper side plate to cover the upper parts of the air channels. Also preferably, the first channel connecting unit further includes first door holes formed at the upper side plate of the door, and the second channel connecting unit further includes second door holes formed at the upper side plate of the door.

Preferably, the oven further includes: a discharge pipe connected between the suction part of the circulating fan and the cooking chamber to discharge heat of the cooking chamber suctioned by the circulating fan out of the oven through the lower end of the door via the channel connecting unit and the first air channel.

In accordance with another aspect, the present invention provides an oven including: a housing having inlet and outlet ports formed at the front surface thereof; a cooking chamber disposed in a housing, the cooking chamber having an opened front surface; a door to open and close the cooking chamber, the door having at least two air channels, which are separated from each other; a circulating fan in the housing outside the cooking chamber, the circulating fan having at least one suction part and at least one discharge part; an inlet duct disposed between the inlet port and the suction part of the circulating fan; and an outlet duct disposed between the outlet port and the discharge part of the circulating fan, wherein the at least two air channels comprise: at least one first air channel, having one end connected to the discharge part of the circulating fan via the channel connecting unit and the other end connected to the outer space communicating with the lower end of the door, to guide air discharged by the circulating fan to the lower end of the door such that the air is discharged out of the oven through the lower end of the door, and at least one second air channel, having one end connected to the suction part of the circulating fan via the channel connecting unit and the other end connected to the outer space communicating with the lower end of the door, to guide air suctioned by the circulating fan from the lower end to the upper end of the door such that the door is cooled by the air.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE PREFERRED EMBODIMENTS

Figure 1:
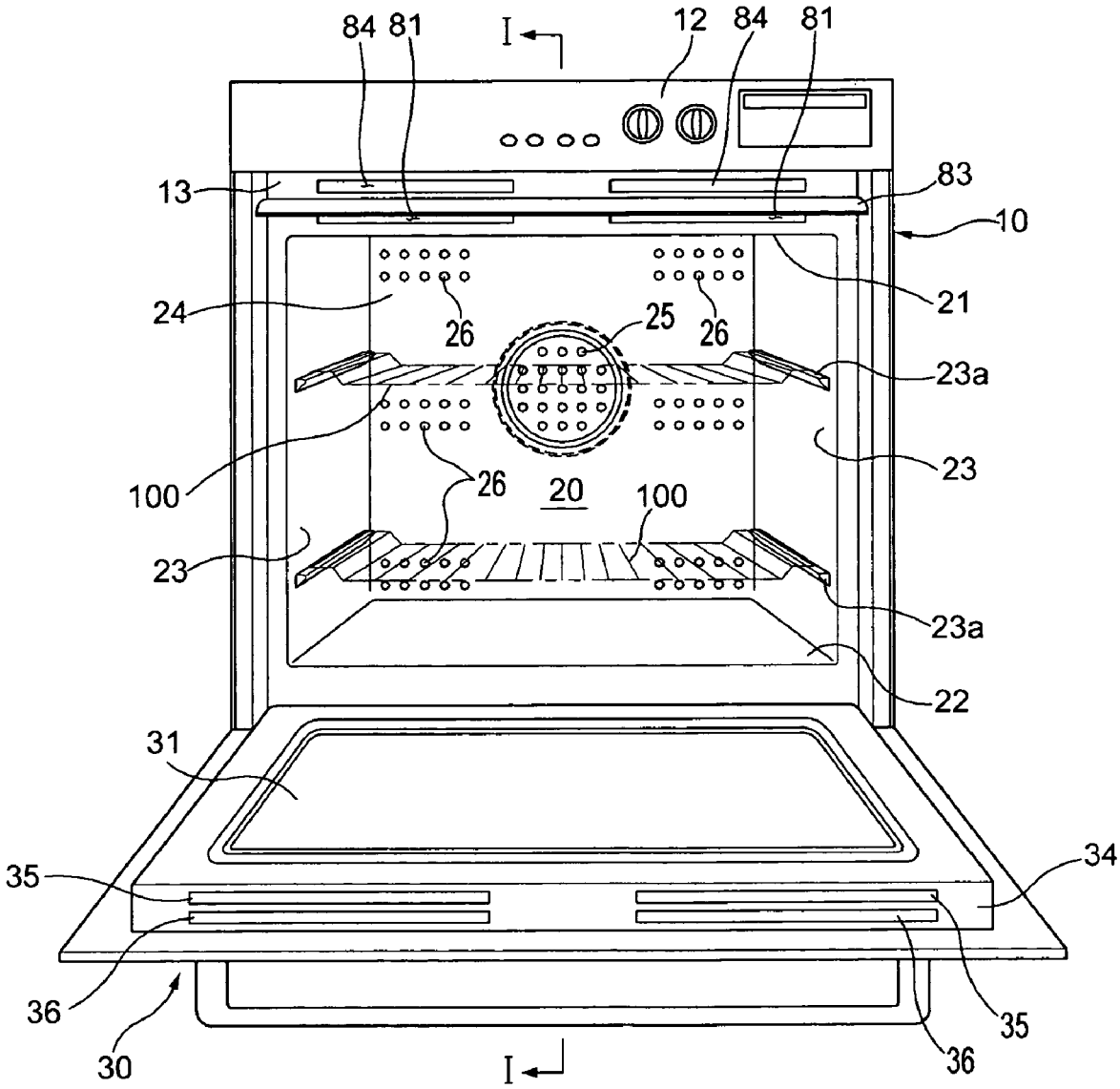
FIG. 1 is a front view showing an oven according to the present invention.

Reference will now be made in detail to embodiments of the present invention, examples of which are illustrated in the accompanying drawings, wherein like reference numerals refer to like elements throughout. The embodiments are described below to explain the present invention by referring to the figures.

Figure 2:
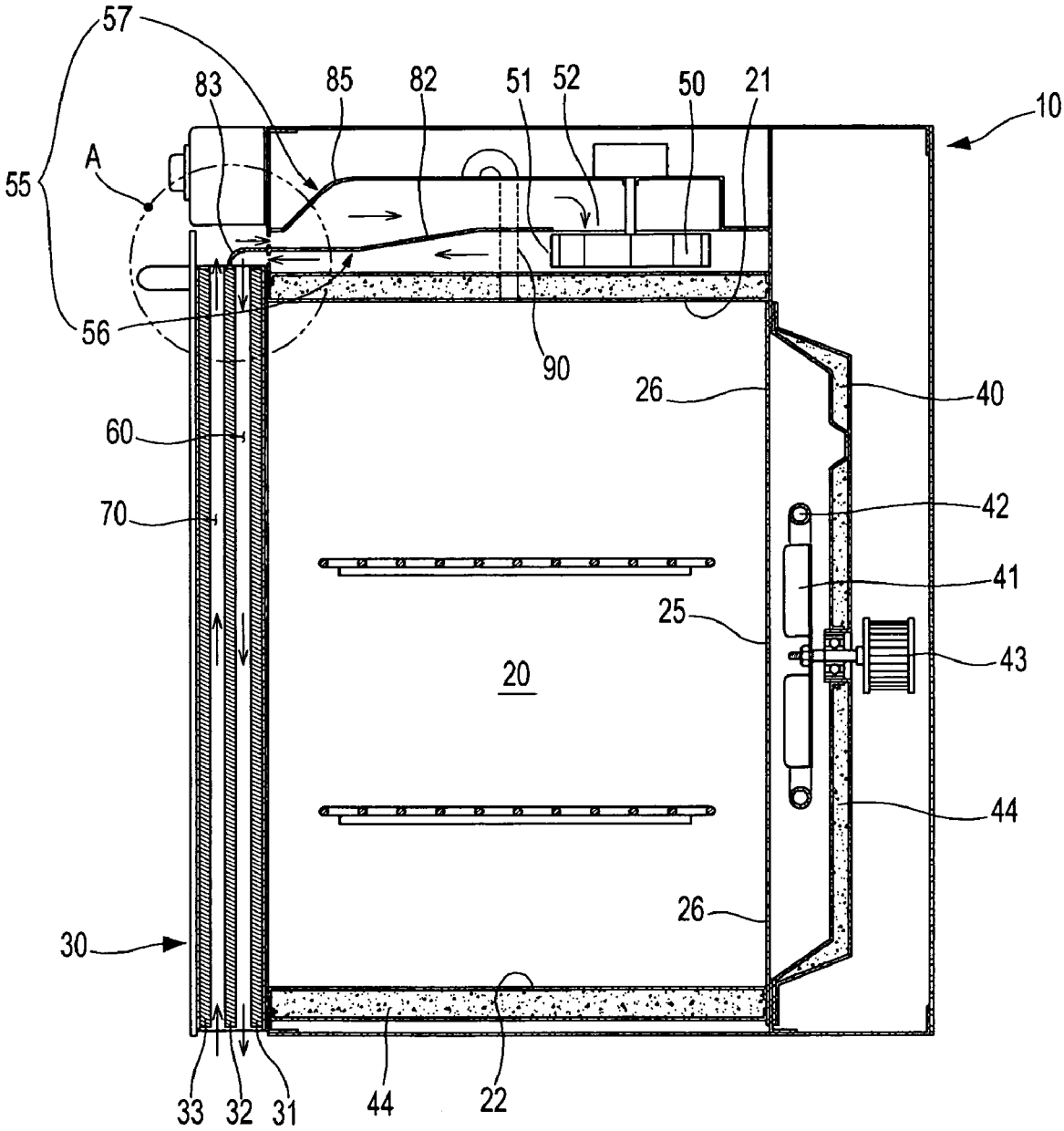
FIG. 2 is a sectional view taken along line I-I of FIG. 1.
Figure 3:
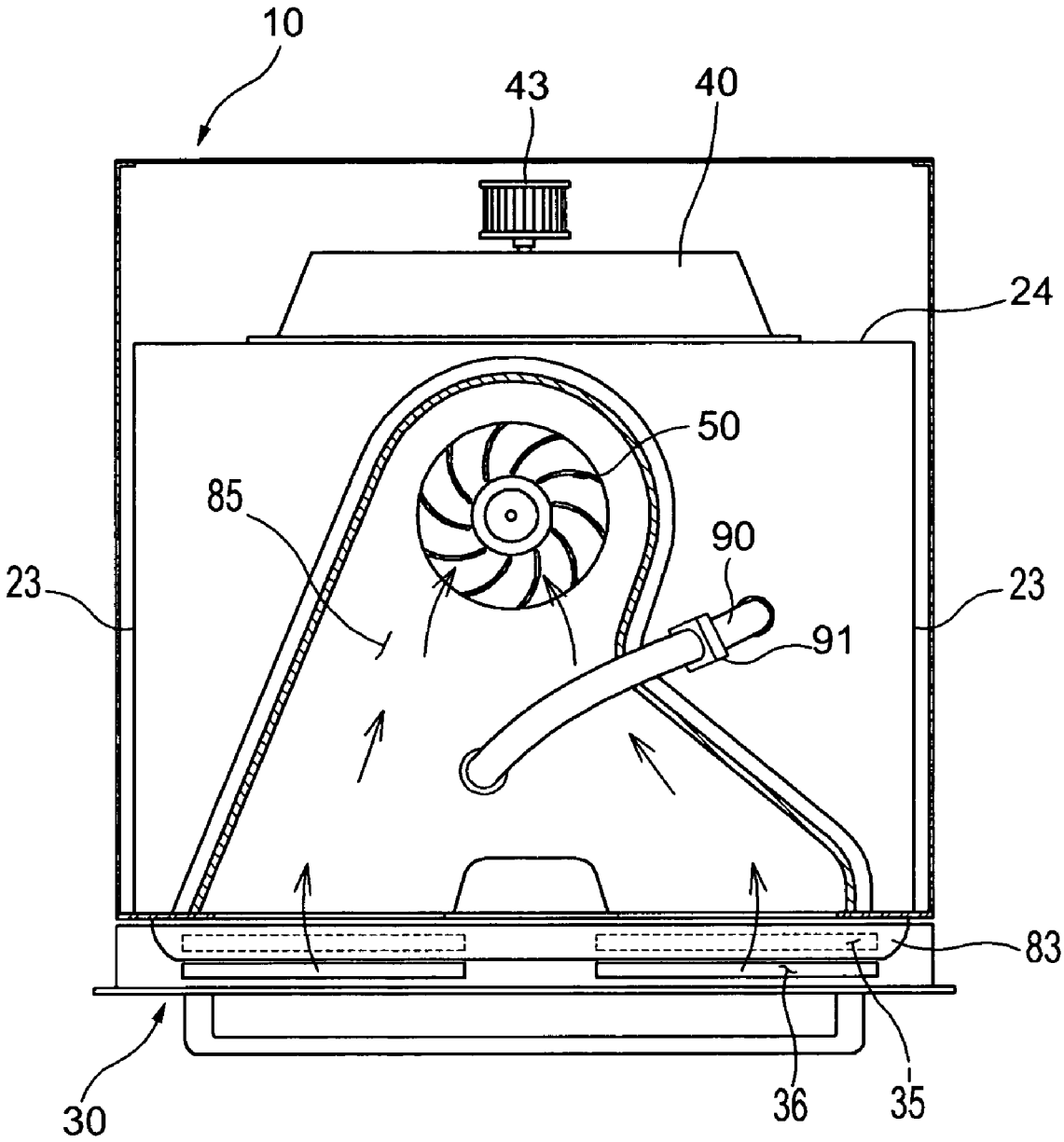
FIG. 3 is a plan view, in section, showing the structure of the oven according to the present invention.

FIG. 1 is a front view showing an oven according to the present invention, FIG. 2 is a sectional view taken along line I-I of FIG. 1, and FIG. 3 is a plan view, in section, showing the structure of the oven according to the present invention.

As shown in FIGS. 1 and 2, the oven includes: a housing 10 having a cooking chamber 20 defined therein, the front surface of the cooking chamber 20 being opened; and a door 30 hingedly connected to the lower end of the housing 10 to open and close the opened front surface of the cooking chamber 20. The housing 10 and the door 30 form the outer appearance of the oven.

The cooking chamber 20 is a cooking space defined by a top plate 21, a bottom plate 22, two side plates 23, and a rear plate 24. Between the cooking chamber 20 and the housing 10 are mounted various components constituting the oven.

To the outside of the rear plate 24 is attached a fan cover 40. Between the rear plate 24 and the fan cover 40 is mounted a convection fan 41 to circulate air through the cooking chamber 20. At the outer circumference of the convection fan 41 is mounted an electric heater 42. Between the fan cover 40 and a rear plate 11 of the housing 10 is disposed a drive motor 43, which is connected to the convection fan 41.

At the center part of the rear plate 24, which is opposite to the convection fan 41, are formed a plurality of suction holes 25 to suction air from the cooking chamber 20. At the edge of the rear plate 24 are formed a plurality of discharge holes 26 to discharge hot air into the cooking chamber 20.

On the outside surfaces of the top plate 21, the bottom plate 22, the side plates 23, by which the cooking chamber 20 is defined, and the fan cover 40 are attached heat-insulating members 44 to thermally insulate the cooking chamber 20. At the upper end of the housing 10 is mounted a control panel 12 to control operation of the oven.

At the inner surfaces of the side plates 23 are mounted rails 23*a* where racks 100 are detachably attached such that food is placed on the racks 100.

When a user puts food onto the respective racks 100 supported by the rails 23*a*, closes the door 30, and manipulates the control panel 12, the electric heater 42 generates heat, and the convection fan 41 is rotated by the drive motor 43. As a result, air is suctioned into the space between the rear plate 24 and the fan cover 40 from the cooking chamber 20 through the suction holes 25, heated by the electric heater 42, and then discharged into the cooking chamber 20 through the discharge holes 26. The discharged hot air is circulated in the cooking chamber 20 to cook the food.

While the food is cooked as described above, the interior temperature of the cooking chamber is increased. As a result, heat generated in the cooking chamber is transmitted to the door, and therefore, the door is heated. The door is a part of the oven that is frequently touched by the user. For this reason, it is important to make sure that the door does not have a high temperature so that it does not burn the user. The present invention is characterized by air channels uses to maintain the door at an appropriate temperature and to discharge hot air generated when cooling the door through the lower end of the door. If the hot air is discharged through the lower end of the door, the hot air is not directed to the user, especially, the user's face, and therefore, the user does not feel the unpleasantness of the hot air. If heat generated in the cooking chamber is discharged simultaneously with the hot air generated when cooling the door, the air channels according to the present invention are more useful.

In the door are formed at least two air channels, which are separated from each other. The at least two air channels comprise: at least one first air channel to discharge hot air generated when cooling the door through the lower end of the door; and at least one second air channel to introduce outside air through the lower end of the door such that the door is cooled by the introduced air. In the following description, a first air channel and a second air channel are formed in the door.

As shown in FIGS. 1 to 4, a circulating fan 50 is mounted at the outside of the upper plate 21 of the cooking chamber 20 to suction outside air and circulate the air along the air channels such that the door 30 is cooled by the air. Between the circulating fan 50 and the air channels 60 and 70 is connected a channel connecting unit 55 such that pressure created by the circulating fan 50 is applied to the lower end of the door 30 through the air channels 60 and 70.

The first air channel 60 has one end connected to a discharge part 51 of the circulating fan 50 via the channel connecting unit 55 and the other end connected to the space outside the door 30 communicating with the lower end of the door 30 to guide the air discharged by the circulating fan 50 to the lower end of the door 30 and to the outside. The second air channel 70 has one end connected to a suction part 52 of the circulating fan 50 via the channel connecting unit 55 and the other end connected to the space outside the door 30 communicating with the lower end of the door 30 to guide the air suctioned by the circulating fan 50 from outside the lower end of the door 30 to the upper end of the door 30 such that the door 30 is cooled.

The door 30 includes an outside glass 33,an intermediate glass 32 and an inside glass 31, which are sequentially disposed between the outside surface and the rear surface of the door 30 while being spaced a predetermined distance from one another. Preferably, the first air channel 60 is formed between the inner side glass 31 and the intermediate glass 32, and the second air channel 70 is formed between the intermediate glass 32 and the outside glass 33. The door 30 has an inside inner surface and an outside inner surface where air is drawn from outside a lower end of the door 30 along the outside inner surface and discharge through the inside inner surface of the door at the lower end.

The channel connecting unit 55 includes: a first channel connecting unit 56 to connect the discharge part 51 of the circulating fan 50 and the first air channel 60; and a second channel connecting unit 57 to connect the suction part 52 of the circulating fan 50 and the second air channel 70.

The first channel connecting unit 56 includes: at least one outlet port 81 formed at a front surface 13 of the housing 10 such that the air discharged by the circulating fan 50 flows out of the housing 10 through the outlet port 81; and an outlet duct 82 having one end connected to the outlet port 81 and the other end connected to the discharge part 51 of the circulating fan 50. If the door 30 further includes an upper side plate 34 to cover the upper parts of the air channels as shown in FIG. 1, the first channel connecting unit may further comprise first door holes 35 formed at the upper side plate 34 of the door 30 such that the discharged air flows through the upper side plate 34 of the door 30.

Figure 4:
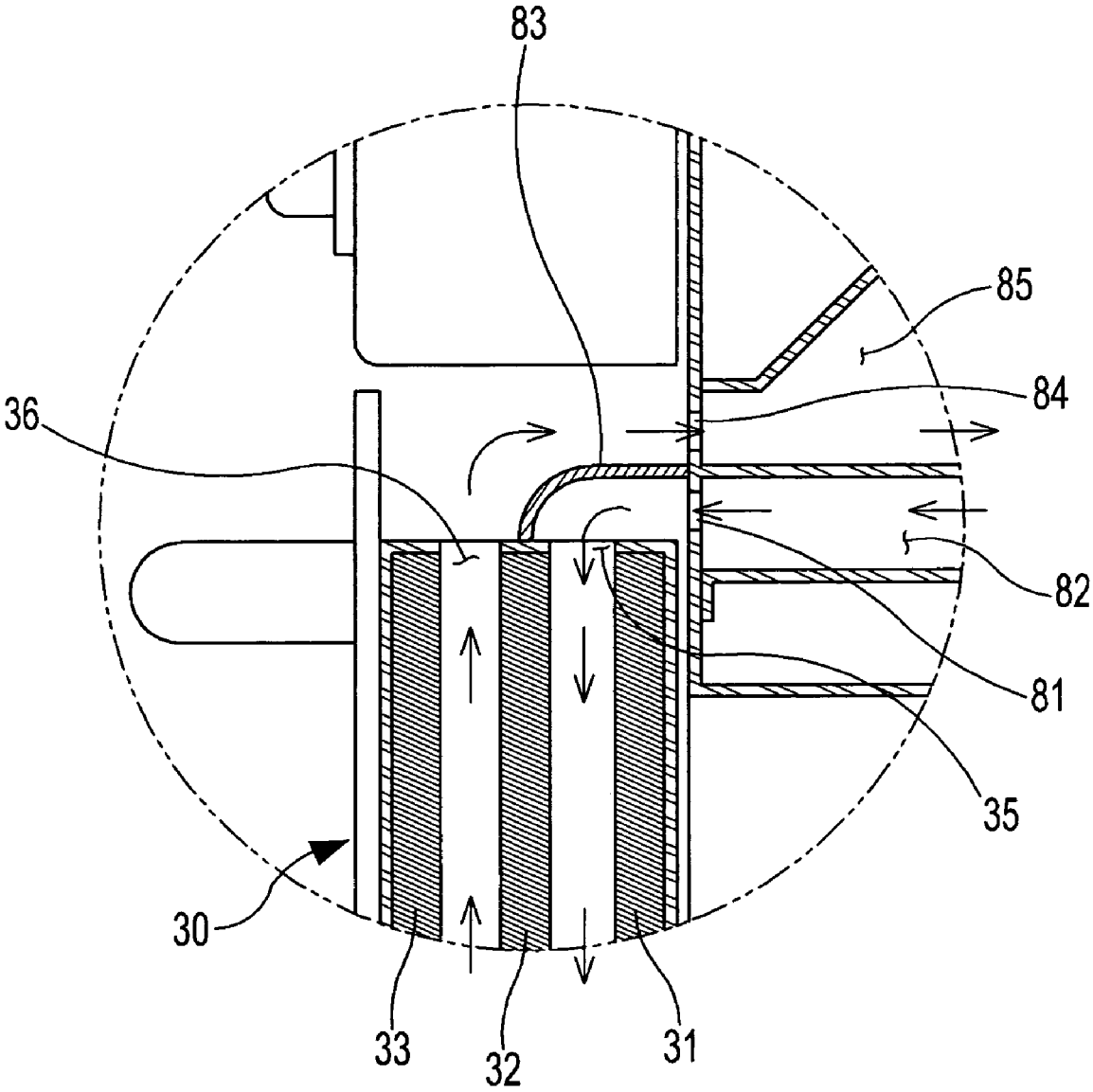
FIG. 4 is an enlarged view showing "A" part of FIG. 2.

Preferably, the first channel connecting unit 56 further includes a guide member 83 disposed between the outlet port 81 and the first air channel 60 to guide the air discharged through the outlet port 81 to the first air channel 60 and prevent interference between the air flowing along the first air channel 60 and the air flowing along the second air channel 70. In the illustrated embodiment, the guide member 83 is fixed to the front surface 13 of the housing 10 above the outlet port 81, although the shape and size of the guide member 83 are not limited so long as the air discharged through the outlet port 81 is guided to the first air channel 60. FIG. 4. illustrates the guide member 83 found in "A" of FIG. 2.

The second channel connecting unit 57 includes: at least one inlet port 84 formed at the front surface 13 of the housing 10 above the outlet port 81 such that air suctioned through the lower end of the door 30 and passing along the second air channel 70 is introduced into the housing 10 through the inlet port 84; and an inlet duct 85 having one end connected to the inlet port 84 and the other end connected to the suction part 52 of the circulating fan 50. If the upper side plate 34 is provided as in the first channel connecting unit 56, the second channel connecting unit 57 may further comprise second door holes 36 formed at the upper side plate 34 of the door 30 such that the air flowing along the second air channel 70 flows through the upper side plate 34 of the door 30.

The oven according to the present invention may further comprise a discharge pipe 90 connected between the suction part 52 of the circulating fan 50 and the cooking chamber 20 such that heat generated in the cooking chamber 20 is suctioned by the circulating fan 50. FIG. 3 illustrates an example of connection of the cooking chamber 20 and the suction part 52 of the circulating fan 50 via the discharge pipe 90. As shown in FIG. 3, one end of the discharge pipe 90 is connected to the top plate 21 (shown in FIG. 1) of the cooking chamber 20, and the other end of the discharge pipe 90 is connected to the inlet duct 85. On the discharge pipe 90 is mounted a discharge valve 91 to control opening and closing of the discharge pipe 90.

The circulation of air, by the circulating fan 50, in the oven with the above-stated construction according to the present invention will be described hereinafter in detail. As the circulating fan 50 is rotated, outside air is introduced into the second air channel 70 through the lower end of the door 30 by a suction force of the circulating fan 50. The introduced air flows along the second air channel 70 to cool the door 30. Hot air that is generated when cooling the door 30 is introduced into the housing 10 through the inlet port 84, flows along the inlet duct 85, and passes through the circulating fan 50. Subsequently, the air flows along the outlet duct 82, and is discharged out of the housing 10 through the outlet port 81. The discharged air is introduced into the first air channel 60 under the guidance of the guide member 83. The introduced air flows to the lower end of the door 30 along the first air channel 60, and is then discharged out of the oven through the lower end of the door 30. When the discharge valve 91 is opened to discharge heat generated in the cooking chamber 20, the heat of the cooking chamber 20 is discharged into the inlet duct 85 through the discharge pipe 90, and is then mixed with the air flowing along the inlet duct 85. The mixed air flows to the lower end of the door 30 along the first air channel 60, and is then discharged out of the oven through the lower end of the door 30.

As apparent from the above description, the present invention provides an oven having air channels, along which low-temperature air flows to cool a door. Consequently, the door is maintained at an appropriate temperature although the temperature of a cooking chamber is high.

Furthermore, hot air generated when cooling the door and heat generated in the cooking chamber are discharged out of the oven through the lower end of the door. Consequently, the hot air and the heat are not directed to a user, and therefore, unpleasantness is effectively prevented.

The oven door 30 preferentially includes an outside glass 33, an intermediate glass 32 and an inside glass 31. However, any other suitable material such as metal, plastic, etc. can be substituted for the outside glass 33, intermediate glass 32 and/or the inside glass 31.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. An oven comprising:

a cooking chamber disposed in a housing;

a door to open and close the cooking chamber, the door having first and second air channels, which are separated from each other;

a circulating fan in the housing outside the cooking chamber; and a channel connecting unit to connect a discharge part of the circulating fan to the first air channel and to connect a suction part of the circulating fan to the second air channel, wherein the first air channel has one end connected to the discharge part of the circulating fan via the channel connecting unit and the other end connected to an outer space communicating with the lower end of the door, to guide air discharged by the circulating fan to the lower end of the door such that the air is discharged out of the oven through the lower end of the door, and the second air channel has one end connected to the suction part of the circulating fan via the channel connecting unit and the other end connected to the outer space communicating with the lower end of the door, to guide air suctioned by the circulating fan from the lower end to the upper end of the door such that the door is cooled by the air, so that when the circulating fan operates, outside air is suctioned into the suction part of the circulating fan through the second air channel to cool the door, and then discharged from the discharge part of the circulating fan to the outside space of the oven through the first air channel and the lower end of the door.

2. The oven according to claim 1, wherein the door includes an outside glass, an intermediate glass, and an inside glass, which are sequentially disposed between the front surface and the rear surface of the door while being spaced a predetermined distance from one another, and wherein the first air channel is formed between the inner side glass and the intermediate glass, and the second air channel is formed between the intermediate glass and the outside glass.

3. The oven according to claim 1, wherein the channel connecting unit comprises a first channel connecting unit to connect the discharge part of the circulating fan and one end of the first air channel, the first channel connecting unit comprising:

at least one outlet port formed at the front surface of the housing such that the air discharged by the circulating fan flows out of the housing through the outlet port, and is then introduced into the first air channel; and an outlet duct disposed between the outlet port and the discharge part of the circulating fan.

4. The oven according to claim 3, wherein the first channel connecting unit further comprises a guide member disposed between the outlet port and the first air channel to guide the air discharged through the outlet port to the first air channel.

5. The oven according to claim 3, wherein the door further includes an upper side plate to cover the upper parts of the air channels, and the first channel connecting unit further comprises first door holes formed at the upper side plate of the door.

6. The oven according to claim 1, wherein the channel connecting unit comprises a second channel connecting unit to connect the suction part of the circulating fan and one end of the second air channel, the second channel connecting unit comprising:

at least one inlet port formed at the front surface of the housing such that air passing along the second air channel is introduced into the housing through the inlet port; and an inlet duct disposed between the inlet port and the suction part of the circulating fan.

7. The oven according to claim 6, wherein the door further includes an upper side plate to cover the upper parts of the air channels, and the second channel connecting unit further comprises second door holes formed at the upper side plate of the door.

8. The oven according to claim 1, further comprising:

a discharge pipe connected between the suction part of the circulating fan and the cooking chamber to discharge heat of the cooking chamber suctioned by the circulating fan out of the oven through the lower end of the door via the channel connecting unit and the first air channel.

9. An oven comprising:

a housing having inlet and outlet ports formed at the front surface thereof;

a cooking chamber disposed in a housing, the cooking chamber having an opened front surface;

a door to open and close the cooking chamber, the door having at least two air channels, which are separated from each other;

a circulating fan in the housing outside the cooking chamber, the circulating fan having at least one suction part and at least one discharge part;

an inlet duct disposed between the inlet port and the suction part of the circulating fan; and an outlet duct disposed between the outlet port and the discharge part of the circulating fan, wherein the at least two air channels comprise:

at least one first air channel, having one end connected to the outlet port and the other end connected to the outer space communicating with the lower end of the door, at least one second air channel, having one end connected to the inlet port and the other end connected to the outer space communicating with the lower end of the door, and a discharge pipe connected between the inlet duct and the cooking chamber to discharge heat of the cooking chamber suctioned by the circulating fan out of the oven through the lower end of the door via the outlet duct, the outlet port, and the first air channel.

10. The oven according to claim 9, wherein the door includes an outside glass, an intermediate glass, and an inside glass, which are sequentially disposed between the front surface and the rear surface of the door while being spaced a predetermined distance from one another, and wherein the first air channel is formed between the inner side glass and the intermediate glass, and the second air channel is formed between the intermediate glass and the outside glass.

11. The oven according to claim 9, further comprising:

a guide member disposed between the outlet port of the housing and the first air channel to guide the air discharged through the outlet port to the first air channel.

12. The oven according to claim 9, wherein the door further includes an upper side plate to cover the upper parts of the air channels, the upper side plate having first door holes communicating with the first air channel and second door holes communicating with the second air channel.

* * * * *